United States Patent [19]

Jones et al.

[11] Patent Number: 4,709,645

[45] Date of Patent: Dec. 1, 1987

[54] WASTE FABRIC AND LINE COLLECTION BOX FOR A SEWING MACHINE

[75] Inventors: Christopher R. Jones, Greensboro; Lee S. Jones, Jamestown, both of N.C.

[73] Assignee: Templex, Inc., High Point, N.C.

[21] Appl. No.: 934,101

[22] Filed: Nov. 24, 1986

[51] Int. Cl.[4] ..... D05B 65/06

[52] U.S. Cl. ..... 112/282; 112/287

[58] Field of Search ..... 112/282, 287, 122, 130

[56] References Cited

U.S. PATENT DOCUMENTS

| | | | |
|---|---|---|---|
| 3,853,079 | 12/1974 | Dunne | 112/282 |
| 4,138,957 | 2/1979 | Blessing et al. | 112/287 |
| 4,672,902 | 6/1987 | Michaels | 112/287 |

*Primary Examiner*—Andrew M. Falik

*Attorney, Agent, or Firm*—Clifton Ted Hunt

[57] ABSTRACT

Waste fabric and lint generated by the cutter knives of a sewing machine are removed as generated by a collection box, the top edges of which are shaped to conform to the contour of a sewing machine frame in a location immediately beneath the cutter knives. The collection box is connected to a source of suction in a waste removal system.

9 Claims, 5 Drawing Figures

WASTE FABRIC AND LINE COLLECTION BOX FOR A SEWING MACHINE

FIELD OF THE INVENTION

The waste fabric and lint collector of this invention is intended for use with a waste removal system for industrial sewing machines of the type equipped with cutter knives for trimming away fabric edges.

BACKGROUND OF THE INVENTION

Industrial sewing machines are frequently provided with cutter knives which cut off uneven edges of fabric so that overlocked stitches cover the edge of one or more pieces of fabric that are sewn. The same sewing machine may be provided with a chain cutter which cuts the leading and trailing ends of thread on the sewing machine.

Apparatus for the collection and removal of cut threads and trimmed fabric from sewing machines are known in the art. See, for example, U.S. Pat. No. 3,853,079 issued Dec. 10, 1974, to Owen F. Dunne for DOUBLE SUCTION UNIT. See also pending application Ser. No. 861,428 filed May 9, 1986, by Christopher R. Jones and Lee S. Jones for DUAL SUCTION UNIT AND METHOD, and assigned to the same assignee as is this application.

The waste and lint collector of the present invention is intended for use with a waste removal system such as described, for example, in the aforesaid Dunne patent and in the said pending application. The waste and lint collector may also be used with other waste removal systems within the spirit of the invention.

It is known in the unpatented prior art to provide a suction inlet adjacent the cutter knives to dispose of trimmed fabric. Specifically, Universal Sewing Machine Company of 1011 E. Park, St. Louis, Mo. 63130, markets a funnel to be positioned adjacent the cutter knives of a sewing machine and attached to a pneumatic waste removal system for carrying away trimmed fabric edges. See the funnel identified at DCW-7R attached to the dual chain and waste remover assembly in Universal's AMATTCO drawing No. C-1506. See also Universal's AMATTCO drawing No. C-1486 illustrating another embodiment at DCW-8 connected to Universal's DUAL CHAIN AND WASTE REMOVER ASSEMBLY.

Universal's DCW-8 funnel has a conventionally round outwardly tapering opening intended to be located beneath the cutter knives to catch and carry away "bulky trimmings".

Universal's DCW-7R funnel does not have an outwardly tapering opening but is a round tube 1½" in diameter and cut on the bias. It, too, is placed below the cutter knives to catch and carry away "normal trimmings".

The prior art funnels for carrying away waste trimmings are generally effective for carrying away "bulky trimmings" and "normal trimmings", but they are spaced too far from the cutter knives and are not effective for entrapping and carrying away lint generated by the action of the cutter knives in trimming fabric. Such lint has heretofore escaped to the atmosphere.

SUMMARY OF THE INVENTION

The waste and lint collector of this invention includes a collection box which is custom shaped to conform with the contour of that portion of a sewing machine in the immediate area of the cutter knives. The peripheral configuration of the collection box is shaped so that it will abut against the proximal portions of the sewing machine and position the collection box in its operative position immediately beneath the effective cutting portion of the cutter knives to thereby direct an inward flow of air past the cutter knives while otherwise substantially sealing the interior of the collection box from communication with the ambient atmosphere.

The inner end of the collection box is communicatively connected with a waste conduit having a negative pressure to induce suction in the area of the cutter knives.

The collection box of the waste and lint collector is adjustably mounted on or adjacent the sewing machine to permit the collection box to be selectively moved between the operative position described above and an inoperative position away from the machine to enable access to the machine for cleaning and maintenance.

One embodiment of the invention is pivotally mounted to enable the collection box to be moved inwardly against the machine in its operative position and to be pivoted outwardly from the machine to its inoperative position.

In a second embodiment, the collection box is removably supported in its operative position in the area of the lint generating cutter knives and may be physically removed when necessary to service or clean the sewing machine. A plurality of sewing machines may be serviced with a waste collection system providing a branch line and a collection box for each sewing machine. The waste collection system preferably includes an additional suction inlet to collect cut threads from adjacent the thread cutters on sewing machines, whereby the cut thread, trimmed fabric edges and lint may be removed through the same waste removal system as is known to those skilled in the art.

The novelty of the present invention is the configuration of the collection box and its supporting structure.

DETAILED DESCRIPTION OF THE INVENTION

Figures 1, 2:
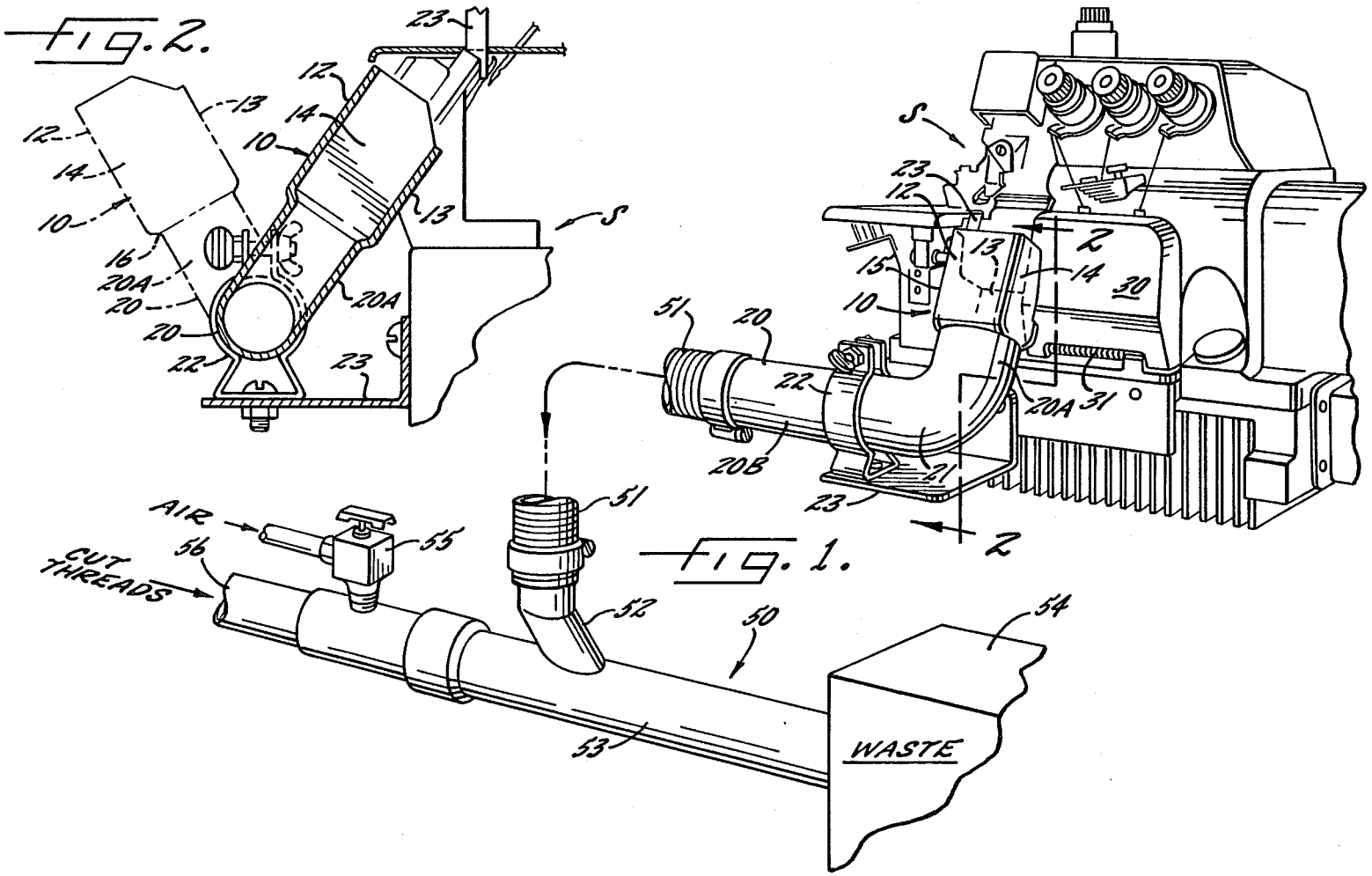
FIG. 1 is a somewhat schematic perspective view, with parts broken away, illustrating the waste and lint collector of this invention in operative position on a sewing machine and illustrating its connection with a waste removal system.
FIG. 2 is a sectional view, partially in elevation, taken substantially along the Line 2—2 in FIG. 1 and illustrating the collector in solid lines at its operative position and in phantom lines at an inoperative position.
Figure 3:
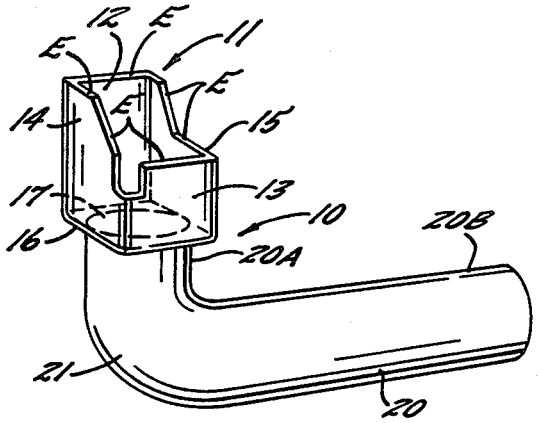
FIG. 3 is a perspective view of the embodiment of the collector shown in FIGS. 1 and 2 but removed from the sewing machine.

One embodiment of the waste fabric and lint collector is shown in FIGS. 1–3 and is broadly indicated at 10.

Figure 4:
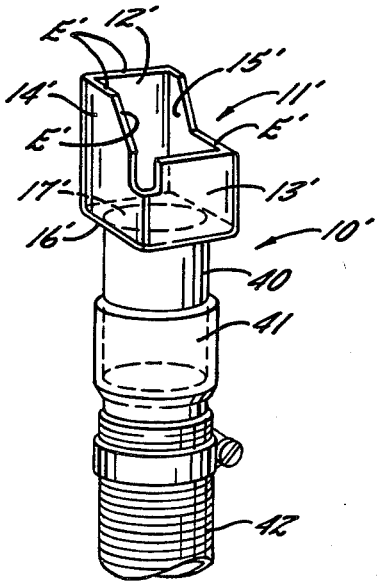
FIG. 4 is a perspective view of another embodiment of the collector removed from the sewing machine.

A second embodiment of the invention is shown in FIG. 4 and broadly indicated at $10^1$.

The collector 10 includes a collection box broadly indicated at 11 and illustrated as being of rectangular configuration with a front wall 12, rear wall 13, and side walls 14, 15. A bottom wall 16 has a circular opening therethrough providing communication between collection box 11 and waste conduit 20 formed integrally with or otherwise fixed to the collection box 11.

The waste conduit 20 has a right angular bend as at 21 between a short portion 20A extending coaxially with the collection box 11 and a relatively longer portion 20B extending in angular relation to the short portion 20A. The long portion 20B is pivotally mounted in a clamp 22 fixed to a bracket 23 extending from the front of a sewing machine S.

The top of collection box 11 is open and the upper edges E of front wall 12, rear wall 13, and side walls 14, 15 are custom shaped to conform with the configuration of the sewing machine around the effective cutting area between cutter knives 23. The collection box illustrated at 11 has been shaped to conform to the configuration of the Juki machine, Model MO-816, sold by Juki Industries of America, 421 N. Midland Avenue, Saddlebrook, N.J.

The edges E engage the proximal portion of the sewing machine and significantly restrict communication between the collection box and the ambient atmosphere as the collection box 11 extends immediately beneath the cutting area between the cutter knives 23 and proximal needles which generate the trimmed fabric and lint associated with sewing.

It is important to the successful practice of the invention that the marginal edges E be custom shaped to conform sufficiently with the contour of any desired sewing machine to position the collector immediately beneath the cutting area between cutter knives 23.

In the illustrated embodiments, the front wall 13 or $13^1$ and side wall 14 or $14^1$ are cut away to conform with the configuration of an access door 30 supported on a hinge 31. When it is desired to open the door 30 as for changing thread or performing maintenance, it is necessary to move the collection box 11 or $11^1$ away from the sewing machine S to gain access to the door 30. In the embodiment of FIG. 1, the collection box 11 is pivoted to the dotted line inoperative position of FIG. 2 by rotating the major portion 20B of conduit 20 on its axis relative to the clamp 22. When the work is completed and the access door 30 has been closed to the position of FIG. 1, the collection box 11 may be moved to its operative solid line position of FIG. 2 by rotating the portion 20B relative to the clamp 22 toward the sewing machine to automatically and easily position the collection box at the operative position.

SECOND EMBODIMENT

Figure 5:
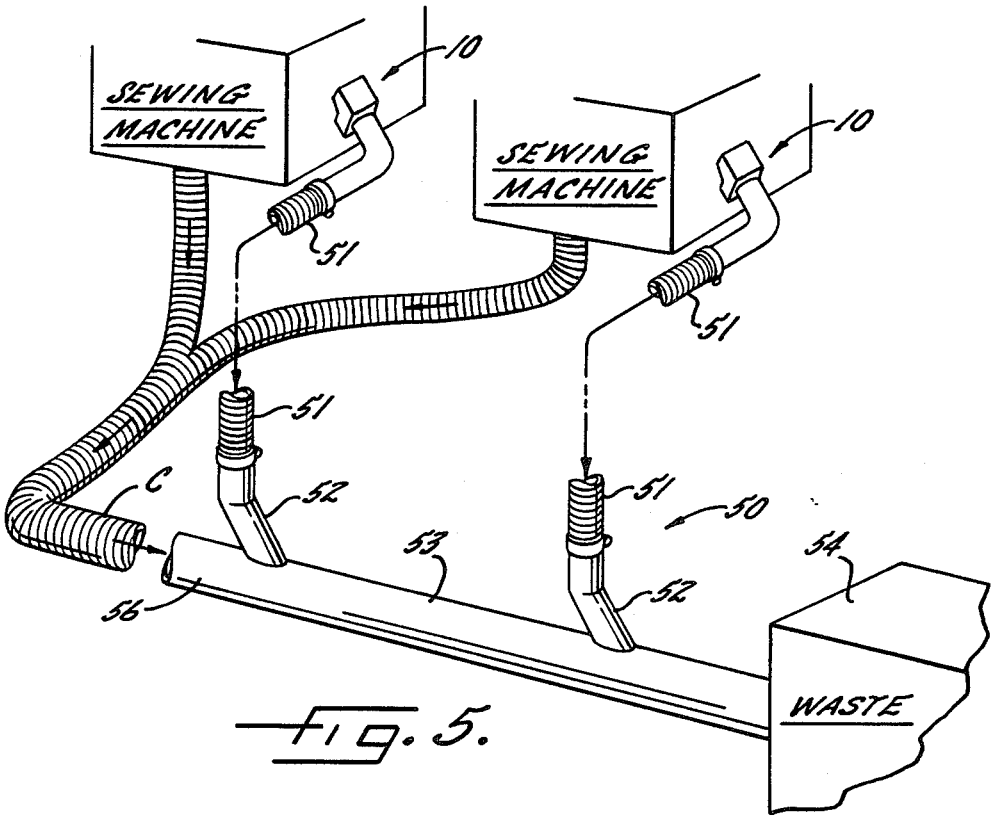
FIG. 5 is a somewhat schematic perspective view illustrating the connection of a plurality of the waste and lint collectors to a waste removal system.

FIG. 4 illustrates a second embodiment wherein parts corresponding to like parts in the first embodiment are indicated by the same reference character with the prime notation added. Thus, the embodiment of FIG. 4 comprises a waste and lint collector $10^1$ including a collection box $11^1$ corresponding in detail to the collection box 11 of the first embodiment so that a further description of the collection box $11^1$ is deemed unnecessary. A waste conduit 40 communicates with the opening $17^1$ and extends from the bottom wall $16^1$ in coaxial relation to the collection box $11^1$. The end of the conduit 40 remote from the collection box $11^1$ is received within a coupling 41 fixed to the end of a flexible conduit 42 extending to a waste collection system generally indicated at 50 in FIG. 5.

The edges $E^1$ of the collection box $11^1$ are custom shaped and fitted against the sewing machine in the manner described in connection with the first embodiment. The second embodiment is used where the construction of the machine and/or the installation of the machine will not permit use of the pivotal collector of the first embodiment. The collection box $11^1$ of the second embodiment can be removed from the coupling 40 by manually grasping and lifting the collection box when desired to gain access to the sewing machine.

OPERATION

The collection boxes of both embodiments are individually connected to flexible conduits 51 which extend between the individual collectors 10 or $10^1$ at each of a plurality of sewing machines S and respective branch lines 52 communicatively connected with a main waste line 53 discharging into a waste container 54. Compressed air is introduced through a venturi assembly 55 into the main waste line 53 upstream from the first branch line 52 and downstream from the free inlet end 56 of the main waste line 53.

As more fully explained in the said pending patent application, Ser. No. 861,428 filed May 9, 1986, by Christopher R. Jones and Lee S. Jones, the passage of compressed air through the venturi 55 creates a suction at the free inlet end 56 of the main tube and creates a suction in the branch line 52 from its respective flexible conduit 51 and associated collector 10 or $10^1$. The free end 56 of the main waste line 53 is connected by a flexible conduit C, to the sewing machines for the collection of cut threads while the trimmed fabric and lint is delivered through the branch tubes 52 to the waste container 54.

There is thus provided a waste and lint collector which effectively collects trimmed fabric and lint before it escapes to the atmosphere and conveys the lint and excess fabric trimmings to a waste container.

Although specific terms have been employed in describing the invention, they are used in a descriptive and generic sense only and not for purposes of limitation.

The claims to invention are:

1. A waste and lint collector for collecting and conveying waste and lint away from a sewing machine having needles for sewing fabric and cutter knives for trimming away excess fabric, said waste and lint collector comprising an open top collection box communicatively connected with an inlet end of a waste conduit, said collection box of rectangular cross-sectional configuration and comprising a front wall, a rear wall and side walls, the tops of said walls defining an edge about the open top of the collector, said edge being shaped to sealingly fit against the frame of the sewing machine and to position the open top of the collection box in an operative position immediately beneath the cutter knives, and means for inducing a flow of air into the collection box from the area of the cutter knives, whereby trimmed fabric and lint is drawn into the collector box as it is generated and before it escapes into the atmosphere.

2. A structure according to claim 1 wherein means are provided for moving the collection box from its operative position beneath the cutter knives to an inoperative position away from the sewing machine.

3. Apparatus according to claim 2 wherein said means for moving the collection box from its operative position to an inoperative position comprises means for pivotally mounting the collection box relative to the sewing machine.

4. Apparatus according to claim 3 wherein said means for pivotally mounting the collection box comprises a portion of said waste conduit extending at an angle to the side walls of the collection box, a bracket extending from the sewing machine, a clamp fixed to the bracket and rotatably supporting the said portion of the waste conduit for movement of the collection box between its operative position beneath the cutter knives and an inoperative position away from the sewing machine.

5. Apparatus according to claim 2 wherein said means for moving the collection box from its operative position to an inoperative position comprises means for removably supporting the collection box in the inlet end of the waste conduit at the operative position of the collection box; whereby the collection box may be removed from the waste conduit and away from the sewing machine to an inoperative position.

6. Apparatus according to claim 1 wherein the means for inducing a flow of air into the collection box from the area of the cutter knive comprises a waste removal system communicatively connected to the waste conduit, and said waste removal system including a source of compressed air and a venturi positioned in the waste removal system to induce a negative pressure in the waste conduit and the collection box, whereby air is induced to flow into the open top of the collection box.

7. Apparatus according to claim 6 wherein said waste removal system includes a main line and at least one branch line extending between the main line and the waste conduit, said venturi communicating with the main line at a point between one end of the main line and the branch line; whereby air is drawn into the collection box and through the waste conduit and branch line to the main line while air is simultaneously drawn into said one end of the main line.

8. Apparatus according to claim 7 wherein means are provided for delivering cut threads to said one end of the main line.

9. A method of collecting and conveying trimmed fabric edges and lint away from a sewing machine as the trimmed fabric edges and lint are generated by cutter knives on the sewing machine, said method comprising the steps of:

(a) providing a collection box having an open top and a front wall, rear wall and side walls, the tops of said walls defining an edge about the open top, (b) shaping the edge to conform to the configuration of the sewing machine sufficiently to position the open top of the collection box to sealingly fit against the portion of said frame immediately beneath the cutter knives, (c) providing a pneumatically operable waste removal system, including a main line, (d) generating a suction current through the main line, and (e) connecting the main line to a waste conduit communicatively connected to the collection box; whereby air is drawn from the area of the cutter knives carrying with it lint and trimmed fabric into the collection box and conveying the lint and trimmed fabric into the waste removal system.

* * * * *